US011359469B2

(12) United States Patent
Archa

(10) Patent No.: US 11,359,469 B2
(45) Date of Patent: Jun. 14, 2022

(54) SYSTEM FOR GAS LIFT AND METHOD OF USE

(71) Applicant: Liberty Lift Solutions, LLC, Houston, TX (US)

(72) Inventor: William Garrett Archa, Decatur, TX (US)

(73) Assignee: Liberty Lift Solutions, LLC, Houston, TX (US)

( * ) Notice: Subject to any disclaimer, the term of this patent is extended or adjusted under 35 U.S.C. 154(b) by 0 days.

(21) Appl. No.: 16/127,782

(22) Filed: Sep. 11, 2018

(65) Prior Publication Data

US 2019/0078422 A1 Mar. 14, 2019

Related U.S. Application Data

(60) Provisional application No. 62/557,410, filed on Sep. 12, 2017.

(51) Int. Cl.
*E21B 43/12* (2006.01)
*E21B 34/06* (2006.01)

(52) U.S. Cl.
CPC ..... *E21B 43/123* (2013.01); *E21B 34/06* (2013.01)

(58) Field of Classification Search
CPC ..... E21B 34/06; E21B 43/123
See application file for complete search history.

(56) References Cited

U.S. PATENT DOCUMENTS 3,482,526 A * 12/1969 Elvis ..... E21B 43/122 417/147
3,630,640 A 12/1971 McMurry et al.
5,069,242 A * 12/1991 Kilgore ..... E21B 43/123 137/155
10,883,350 B2 1/2021 Shen et al.
2002/0029883 A1* 3/2002 Vinegar ..... E21B 34/066 166/250.15
2002/0096332 A1* 7/2002 De Almeida ..... E21B 43/123 166/319
2009/0194293 A1 8/2009 Stephenson et al.
(Continued)

FOREIGN PATENT DOCUMENTS

CA 1206090 A 6/1986

OTHER PUBLICATIONS

Blann, J.R. and Williams, J.D. 1984. Determining the Most Profitable Gas Injection Pressure for a Gas Lift Installation (includes associated papers 13539 and 13546). J Pet Technol 36 (8): 1305-1311. SPE-12202-PA. http://dx.doi.org/10.2118/12202-PA.
(Continued)

*Primary Examiner* — Abby J Flynn
*Assistant Examiner* — Yanick A Akaragwe
(74) *Attorney, Agent, or Firm* — The Kubiak Law Firm, PLLC

(57) ABSTRACT

Gas is injected into the interior of the production string. The gas eventually reaches a gas lift mandrel that provides access from the interior of the gas lift mandrel to a chamber on the exterior of the gas lift mandrel. The chamber includes a cap that provides gas access between the interior of the chamber and the annulus. However, the cap is fitted with a gas lift valve and a check valve that regulates the gas flow into the fluid.

9 Claims, 2 Drawing Sheets

(56) References Cited

U.S. PATENT DOCUMENTS

2013/0087343 A1* 4/2013 Juenke ..... E21B 43/123
166/372
2016/0145982 A1 5/2016 Otta et al.

OTHER PUBLICATIONS

Vogel, J.V. 1968. Inflow Performance Relationships for Solution-Gas Drive Wells. J Pet Technol 20 (1): 83-92 SPE 1476-PA. http://dx.doi.org/10.2118/1476-PA.

Orkiszewsk, J. 1967. Predicting Two-Phase Pressure Drops in Vertical Pipe. J Pet Technol 19 (6): 829-838. SPE-1546-PA. http://dx.doi.org/10.2118/1546-PA.

Hagedorn, A.R. and Brown, K.E. 1964 The Effect of Liquid Viscosity in Two-Phase Vertical Flow. J Pet Technol 16 (2):203-210. SPE-733-PA. http://dx.doi.org/10.2118/733-PA.

Beggs, D.H. and Brill, J.P. 1973. A Study of Two-Phase Flow in Inclined Pipes. J Pet Technol 25 (5): 607-617. SPE-4007-PA. http://dx.doi.org/10.2118/4007-PA.

Hernandez, A. (2016): Fundamentals of Gas Lift Engineering, Well Design and Troubleshooting. ISBN 978-0-12-804133-8 Gulf Professional Publishing, Cambridge, MA, 966p.

McMurry-Hughes Standard Mandrels; McMurry-Hughes Price List (Jun. 1, 1984).

Annular Gas Lift Well Design (2010).

Capsule for Annular Flow (2010).

Annular Gas Lift Well Design (2017).

Schlumberger, Gas Lift Design and Technology, 2000.

ANSI/API Specification 19G1, First Ed. Nov. 1, 2010. Side Pocket Mandrels.

Petroleum Technology Company AS, 2015, Gas-Lift Well Design.

McMurry-Macco Lift Systems Catalog (Apr. 1996) 40 pgs.

Monarch Lift Systems, Inc.: Monarch Standard Gas Lift Valves; Monarch Standard Gas Lift Mandrels (1986) 3 pgs.

Bravo Natural Resources—Owl Road, Annular Flow Unloading Design, 2016, 29 pages.

* cited by examiner

SYSTEM FOR GAS LIFT AND METHOD OF USE

CROSS-REFERENCE TO RELATED APPLICATIONS

This application claims priority to U.S. Provisional Patent Application No. 62/557,410 that was filed on Sep. 12, 2017.

BACKGROUND

Generally, when a well is drilled at least one hydrocarbon bearing formation is intersected. Part of the process of completing the well includes installing a liner within the well where the liner also intersects the hydrocarbon bearing formation. Once the liner is in place, ports are opened up through the liner so that fluids, usually at least water and oil, may flow from the hydrocarbon bearing formation to the interior of the liner. Usually, in a newly completed well there is sufficient pressure within the hydrocarbon bearing formation to force the fluid from the hydrocarbon bearing formation to the surface. After some period of time the pressure gradient drops to the point where the fluid from a hydrocarbon bearing formation is no longer able to reach the surface.

Once the fluids are no longer able to naturally reach the surface artificial lift may be employed. One form of artificial lift is known as gas lift. In a conventional gas lift operation, a production tubular is run into the well. The production tubular is assembled on the surface and includes a packer and a number of gas lift mandrels. Each gas lift mandrel has a check valve and a conventional injection pressure operated gas lift valve.

The production tubular is then run into the well so that the packer may be set at some point above the ports in the liner to the hydrocarbon bearing formation. Once the packer is set fluid may flow from a hydrocarbon bearing formation into an annular area between the liner and the production tubular. The packer prevents the fluid from flowing in the annular area above the packer however the fluid may flow to the bottom of the production tubular and into the production tubular. Once the fluid is in the production tubular it may flow upwards to a level dependent upon the hydrocarbon bearing formation pressure gradient. The fluid in the production tubular will generally flow up past the annular packer and will flow upwards past at least one of the gas lift mandrels. Each check valve in the gas lift mandrels prevents the fluid within the production tubular from flowing through the gas lift mandrel and into the annular area above the packer.

In order to begin producing the fluid to the surface high-pressure gas, such as nitrogen, is injected into the annular area between the liner and the production tubular. The only outlet for the high-pressure gas is through the gas lift valves into the gas lift mandrels and then into the interior of the production tubular. As the high-pressure gas reaches a gas lift valve the high-pressure gas flows into the gas lift valve through ports in the side of the gas lift valve. The ports are located between the gas lift valve seat and the bellows. The high-pressure gas acts on the bellows adapter and the bellows to compress the bellows which in turn lifts the ball off of the seat. With the ball off of the seat the high-pressure gas is able to flow through the seat into the check valve. The high-pressure gas then acts upon the check dart to compress the check dart against the spring and lifting the check dart off of the check pad allowing the high-pressure gas to flow through the check valve and into the gas lift mandrel. As the gas flows out of the gas lift mandrel and into the interior of the production tubular adjacent the gas lift mandrel the high-pressure gas causes the fluid to become a froth. The effect is similar to blowing bubbles into milk through a straw. The column of fluid which is now froth has a much lower density and therefore a lower head pressure than a pure liquid column. The natural formation pressure in conjunction with the flow of high pressure gas now flowing upward through the production tubular lifts the froth, and thus the hydrocarbons and other fluid, to the surface.

SUMMARY

In certain operations it has been found advantageous to reverse the flow of injection gas and fluids from the hydrocarbon bearing formation. In this instance, again, the production tubular is assembled on the surface. However, in place of the packer and the associated equipment to set the packer a simple plug may be placed on the bottom of the tubular. A number of gas lift mandrels are included in the production tubular assembly.

As noted previously the conventional gas lift mandrel has a port from the exterior to the interior of the production tubular. A 90° fitting is placed on the exterior of the port and is generally welded into position. The 90° fitting is threaded so that a check valve may be threaded into the 90° fitting and the gas lift valve is threaded into the top of the check valve. High-pressure gas then enters the gas lift valve, where the high-pressure gas flows into the interior of the gas lift valve, then into the check valve, and then into the interior of the production tubular through the gas lift mandrel. It is noted that while other orientations may be utilized generally the 90° fitting is utilized to allow the check valve or gas lift valve to have an orientation that is roughly parallel to the mandrel and production tubular.

In an embodiment of the current invention however the gas lift mandrel is constructed so that again there is a port between the exterior to the interior of the production tubular through the gas lift mandrel. A 90° fitting is placed on the exterior of the port and is generally welded into position. A containment tube having sufficient length to contain a gas lift valve and a check valve with some room to spare is then attached to the 90° fitting. Again, generally by welding. A gas lift valve is then threaded into the top of a check valve. The check valve is then threaded into a cap for the containment tube that allows fluid and gas flow therethrough. The gas lift valve and check valve are then placed inside the containment tube such that the upper end of the gas lift valve is closest to the 90° fitting with the check valve being on the other side of the gas lift valve. The through bore fitting is then secured to the tubular usually by a second set of threads although other known arrangements may be utilized. The containment tube cap is gas tight to the tubular and the tubular is gas tight to the 90° fitting.

In operation the production tubular is run into the well such that at least one of the gas lift mandrels are below the surface of the fluid from a hydrocarbon bearing formation. The fluid in the annular area between the production tubular and the liner is prevented from entering the production tubular by the one-way check valve, which is now oriented to block the fluid which may reach the check valve from the exterior of the gas lift mandrel through the through bore in the containment tube cap.

As noted before a packer is not necessary in this configuration as high-pressure gas is run into the interior of the production tubular and is generally prevented from exiting the production tubular by a cap or plug on the end of the production tubular. The exit for the high-pressure gas is through the port in the gas lift mandrel through the 90° fitting and into the containment tube. The high-pressure gas in the containment tube then surrounds the gas lift valve where the pressure of the high-pressure gas acts on the bellows and bellows adapter to raise the ball off of the seat in the gas lift valve thereby allowing the high-pressure gas to flow into and through the gas lift valve, through the check valve where the gas exits the check valve through the containment tube cap, and into the annular area between the liner or casing and the production tubular causing the fluid to become a froth. The fluid which is now froth has a much lower density and therefore lower head pressure than a pure liquid column. The natural formation pressure in conjunction with the flow of high-pressure gas now flowing upward through the annular area lifts the froth, which includes hydrocarbons and other fluid, to the surface. Additionally, by producing the froth through the annular area between the production tubular and the liner a much larger cross-sectional flow area as compared to the cross-sectional flow area of the production tubular may be accessed.

Another embodiment of the gas lift system has a mandrel with a port that allows fluid flow between an exterior and an interior of the mandrel. The mandrel is connected at its upper end and its lower end to a production tubular. A containment chamber is connected to the mandrel allowing fluid flow between the port and the exterior of the tubular. The fluid flow is through the containment chamber. The gas lift system may include a cap that allows access to the interior of the containment chamber. The cap allows fluid flow between an interior of the containment chamber and the exterior of the mandrel. A gas lift valve is within the containment chamber and the gas must pass through the gas lift valve to exit the containment chamber. A check valve is usually within the containment chamber, and the gas must pass through the check valve to exit the containment chamber. Typically, the gas flows through the check valve only from an interior of the chamber to the exterior of the mandrel.

In another embodiment of the gas lift system a gas lift valve is connected to a production tubular such that gas within the production tubular may flow from an interior of the production tubular to an exterior the production tubular through the gas lift valve. The gas lift valve may be within the interior of the production tubular but more usually the gas lift valve is within a chamber on the exterior of the production tubular. The gas lift valve must be attached to the interior of the production tubular on the surface. The gas lift system also includes a one-way valve allowing gas to flow only from the interior of the production tubular to the exterior the production tubular.

Generally, the gas lift system may be used by pressurizing a production tubular with a gas. Forcing the gas from an interior of the production tubular to an exterior of the production tubular such that upon exiting the production tubular the gas enters a containment chamber. The gas within the containment chamber then opens a gas lift valve allowing the gas to flow through the gas lift valve and injecting the gas from the gas lift valve into a fluid. The containment chamber is sealed with a gas lift valve attached to a cap. The gas lift valve is in the interior of the containment chamber. The cap allows fluid flow between an interior of the containment chamber and the exterior of the production tubular. A check valve is usually located between the gas lift valve and the cap. When a check valve is included the gas generally passes through the check valve to exit the containment chamber. The gas flows through the check valve only from an interior of the chamber to the exterior of the mandrel.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
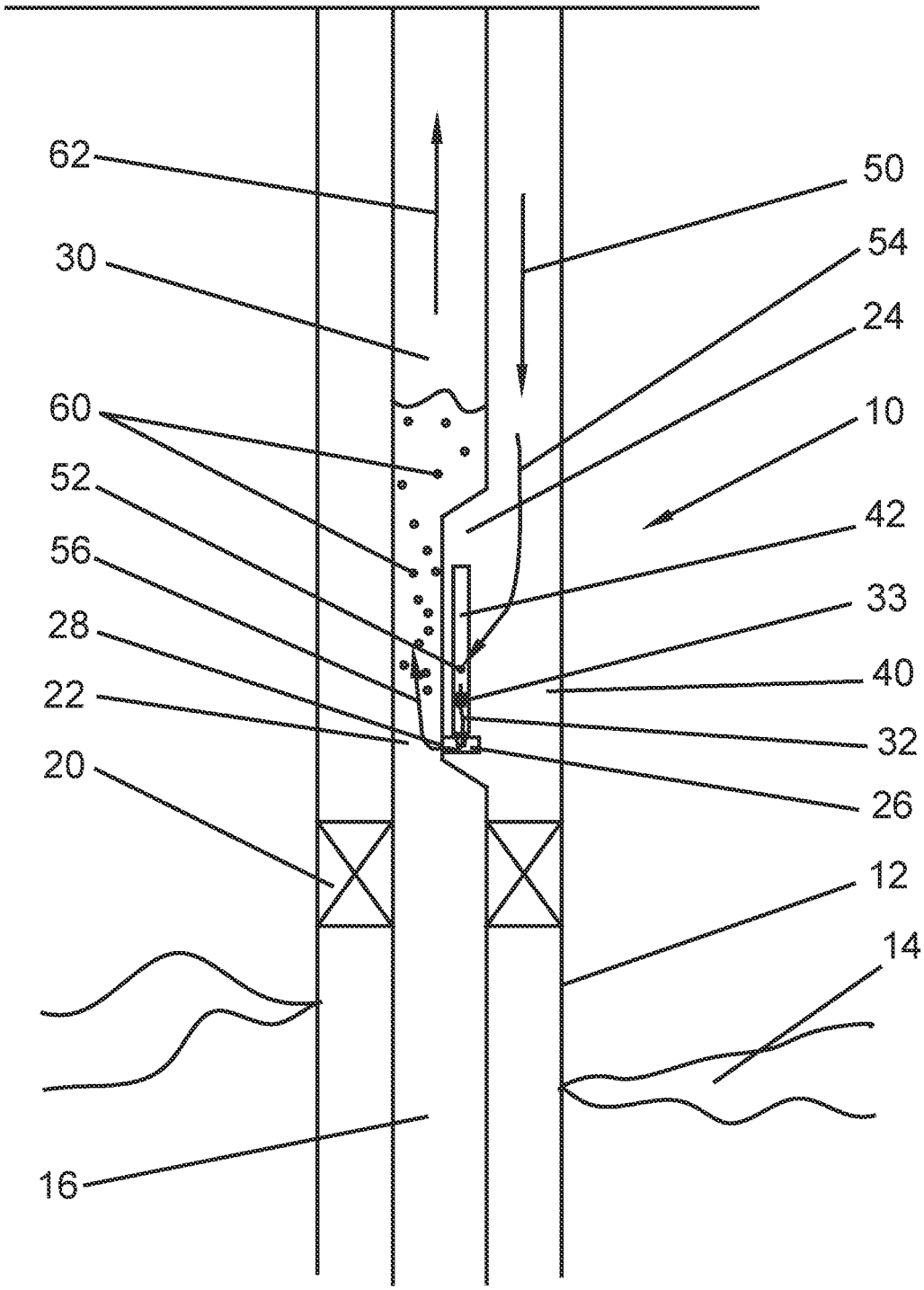
Figure 1 (Prior Art)
FIG. 1 depicts annular gas injection.

FIG. 1 depicts a prior art system 10 having a liner 12 that intersects the hydrocarbon bearing formation 14. A production tubular 16 having a packer 20 has been run into the liner 12 so that the packer 20 is placed at some location above hydrocarbon bearing formations 14. The production tubular 16 includes a gas lift mandrel 22. The gas lift mandrel 22 usually has a recessed area gas lift to reduce the overall diameter of the gas lift mandrel 22 and gas lift valve 42. A port 28 allows gas access from the exterior of the production tubular 16 to the interior 30 of the production tubular 16 through a 90° fitting 26. Check valve 32 is attached to 90° fitting 26 so that fluid in the interior 30 of the production tubular 16 is prevented from flowing into the annular area 40 between the liner 12 in production tubular 16. Check valve 32 allows gas flow from the annular area 40 to flow through check valve 32 and into 90° fitting 26 and further into the interior 30 of the production tubular 16. A gas lift valve 42 is attached, usually by threads, to the inflow area 33 of check valve 32.

When high-pressure gas, as indicated by arrow 50, is injected into the annular area 40, packer 20 prevents the gas from flowing downward towards the hydrocarbon bearing formations 14. In certain instances, packer 20 may be formed by the fluid in the lower portion of the well. The only viable exit for the gas 50 is through port 52 in gas lift valve 42. The gas pathway into port 52 is shown by arrow 54. The gas then flows into the interior portion of gas lift valve 42 into and through check valve 32 into and through 90° fitting 26 and into the interior region 30 of the production tubular 16 as indicated by arrow 56. The gas that enters the interior 30 of the production tubular 16 causes the fluid within the production tubular to froth as indicated by bubbles 60. The froth and high-pressure gas then exit through the production tubular as indicated by arrow 62.

Figure 2:
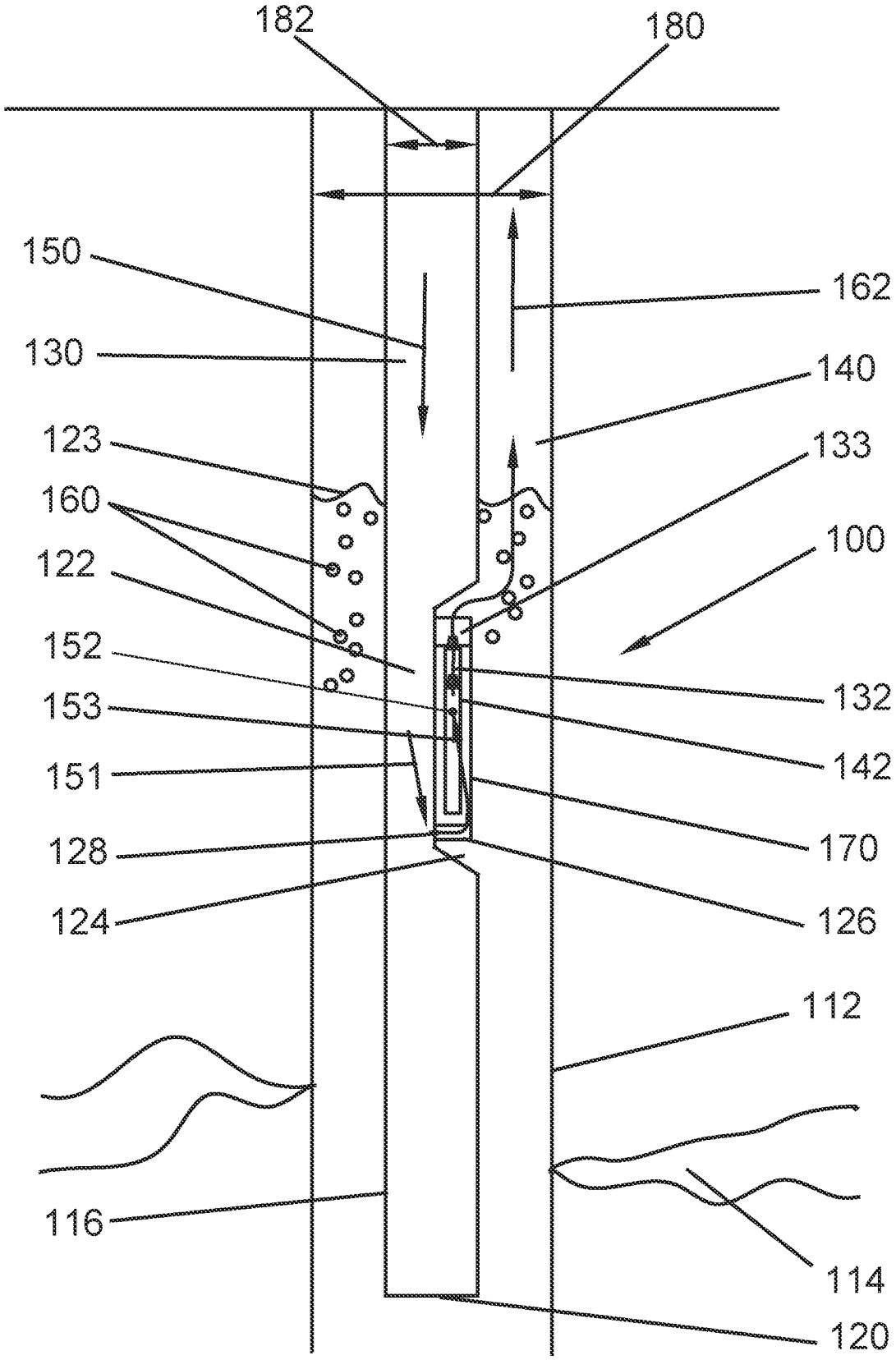
FIG. 2 depicts the system for tubular gas injection.

FIG. 2 depicts the current invention where the gas lift system 100 has a liner or casing 112 that intersects hydrocarbon bearing formation 114. The production tubular 116 includes a plug or closed end 120 at some point below the gas lift mandrel 122. In some instances the closed end 120 may be considered closed due to the presence of fluids at a sufficient pressure to prevent the high pressure gas within the production tubular 116 from reaching the lower end of the production tubular 116. The production tubular 116 is run into the liner 112 so that the gas lift mandrel 122 is at some point below the top of the fluid 123. Generally the gas lift mandrel 122 has a recessed area 124 to reduce the overall diameter of the mandrel and gas lift valve. A port 128 allows gas access from the interior 130 of the production tubular 116 to the exterior of the production tubular 116 through a 90° fitting 126. Gas tight containment tube 170 is attached to 90° fitting 126, typically by welding. A check valve 132 is connected usually by threads to containment tube cap 133. A gas lift valve 142 is then connected to check valve 132 again typically by threads. Containment tube cap 133 is then threaded into gas tight tubular 170.

High-pressure gas, as indicated by arrow 150, is injected into the interior region 130 of the production tubular 116. End cap 120 prevents the high-pressure gas from exiting the production tubular. The only exit for the high-pressure gas is depicted by arrows 151 and 153 which indicate the path of the high-pressure gas flow through port 128 which in turn allows the gas to flow through the 90° fitting around the exterior of the gas lift valve and then into port 152 where the gas enters the interior region of gas lift valve 142. The high-pressure gas acts upon the bellows and stem assembly within gas lift valve 142 to raise the ball off of the seat within gas lift valve 142 allowing the high-pressure gas to flow out of gas lift valve into check valve 132 and then into the annular area 140 where the gas causes the fluid to become a froth as indicated by bubbles 160. The froth, hydrocarbons, other fluids, and gas, then proceed to the surface through the annular area 140 is indicated by arrow 162. The cross-sectional area of the annular area 140 is the cross-sectional area of the liner 112 as indicated by arrow 180 less the cross-sectional area of the production tubular indicated by arrow 182. Generally, the cross-sectional area of the annular area 140 is greater than the cross-sectional area of the production tubular allowing higher fluid flow rates through the annular area as compared to the production tubular.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A gas lift system comprising;

a mandrel having a port that allows fluid flow between an exterior and an interior of the mandrel, wherein the mandrel is connected at its upper end and its lower end to a production tubular, and a containment chamber, having a separate gas lift valve within the containment chamber, on the exterior of the mandrel allows fluid flow between the port, through the separate gas lift valve, and the exterior of the mandrel, wherein the fluid flow is through the containment chamber, a check valve within the containment chamber, wherein gas must pass through the check valve to exit the containment chamber, further wherein gas flows through the check valve only from an interior of the chamber to the exterior of the mandrel.

2. A gas lift system comprising;

a gas lift valve connected to a production tubular such that gas within the production tubular may flow from an interior of the production tubular to an exterior of the production tubular through the gas lift valve, and a containment chamber on the exterior of the production tubular wherein the gas lift valve is within the containment chamber, further wherein the gas lift valve is separate from the containment chamber, and a one-way valve allowing gas to flow only from the interior of the production tubular to the exterior of the production tubular.

3. A method for producing fluids from a well comprising;

pressurizing a production tubular with a gas, forcing the gas from an interior of the production tubular to an exterior of the production tubular, wherein upon exiting the production tubular the gas enters a containment chamber on an exterior of a mandrel, opening a separate gas lift valve within the containment chamber wherein the gas flows through the separate gas lift valve, and injecting the gas from the gas lift valve into a fluid.

4. The method for producing fluids from a well of claim 3, wherein the containment chamber is sealed with the gas lift valve attached to a cap.

5. The method for producing fluids from a well of claim 4, wherein the gas lift valve is in the interior of the containment chamber.

6. The method for producing fluids from a well of claim 4, wherein the cap allows fluid flow between an interior of the containment chamber and the exterior of the production tubular.

7. The method for producing fluids from a well of claim 4, wherein a check valve is located between the gas lift valve and the cap.

8. The method for producing fluids from a well of claim 7, wherein the gas must pass through the check valve to exit the containment chamber.

9. The method for producing fluids from a well of claim 7, wherein the gas flows through the check valve only from an interior of the containment chamber to an exterior of the containment chamber.

* * * * *